US005834914A

United States Patent [19]

Moe et al.

[11] Patent Number: 5,834,914

[45] Date of Patent: Nov. 10, 1998

[54] RAILROAD CROSSING GATE MECHANISM CONTROL SYSTEM

[75] Inventors: James E. Moe, Circle Pines; Donald L. LeVoir, Coon Rapids, both of Minn.

[73] Assignee: Safetran Systems Corporation, Minneapolis, Minn.

[21] Appl. No.: 924,897

[22] Filed: Sep. 8, 1997

[51] Int. Cl.[6] ..... H02P 7/06

[52] U.S. Cl. ..... 318/280; 318/286; 246/125

[58] Field of Search ..... 318/280–286, 318/466–470, 434, 293, 362–370, 380; 49/26–28; 246/125–128, 129, 130; 361/23, 25, 27, 31

[56] References Cited

U.S. PATENT DOCUMENTS

| | | | |
|---|---|---|---|
| 1,592,972 | 7/1926 | Farnsworth . | |
| 1,700,933 | 2/1929 | Gurden . | |
| 2,488,313 | 11/1949 | Miskelly . | |
| 3,038,991 | 6/1962 | Swanton . | |
| 3,601,603 | 8/1971 | Hughson | 246/125 |
| 3,930,191 | 12/1975 | Loderer | 318/376 |
| 3,964,704 | 6/1976 | Karr | 246/125 |
| 3,991,352 | 11/1976 | Fry et al. | 318/759 |
| 4,006,392 | 2/1977 | Catlett et al. | 318/266 |
| 4,090,685 | 5/1978 | Pappas | 246/125 |
| 5,502,367 | 3/1996 | Jones | 318/281 |

*Primary Examiner*—Jonathan Wysocki

*Attorney, Agent, or Firm*—Dorn, McEachran, Jambor & Keating

[57] ABSTRACT

A railroad crossing gate electrical control system for moving a crossing gate in up and down directions and providing snubbing protection to gate movement in failure modes includes an electrical motor having two diametrically positioned permanent magnet poles and two series connected electromagnet poles. There is an armature which rotates inside of the poles. There is a motor and snub relay which has contacts connected to the armature and the series connected electromagnet poles. A terminal board has movable contacts which are connected to the motor and snub relay and to a relay coil for moving the contacts of the motor and snub relay. A source of power is connected to the terminal board, with the movable terminal board contacts controlling the application of power to the motor snub relay coil and the relay contacts for causing up and down movement and for providing snubbing of armature movement during up and down gate movement and gate failure modes. An overspeed control is connected across the armature for limiting armature speed.

7 Claims, 1 Drawing Sheet

RAILROAD CROSSING GATE MECHANISM CONTROL SYSTEM

THE FIELD OF THE INVENTION

The present invention relates to a railroad highway crossing gate mechanism with enhanced fail-safe and failure prevention operating characteristics. The control circuit for gate operation uses an electric motor having two permanent magnetic poles and two series wound electromagnet poles. This particular type of motor in combination with a specific electrical circuit using resistors to provide snubbing control provides excellent operating characteristics over normal gate movement in the up and down directions and will resist and prevent gate mechanism damage from all known failure modes.

SUMMARY OF THE INVENTION

The present invention relates to a railroad highway crossing gate mechanism using an electric motor with two permanent magnet poles and with enhanced capability for preventing gate mechanism damage from all known failure modes.

Another purpose of the invention is a control circuit for a railroad highway crossing gate mechanism which utilizes a motor with two series wound electromagnet poles and two permanent magnetic poles in cooperation with snubbing resistors to control gate movement in normal operation and during all known failure modes.

Another purpose of the invention is to provide a crossing gate mechanism control circuit having overspeed protection for retarding armature movement during certain predetermined conditions.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
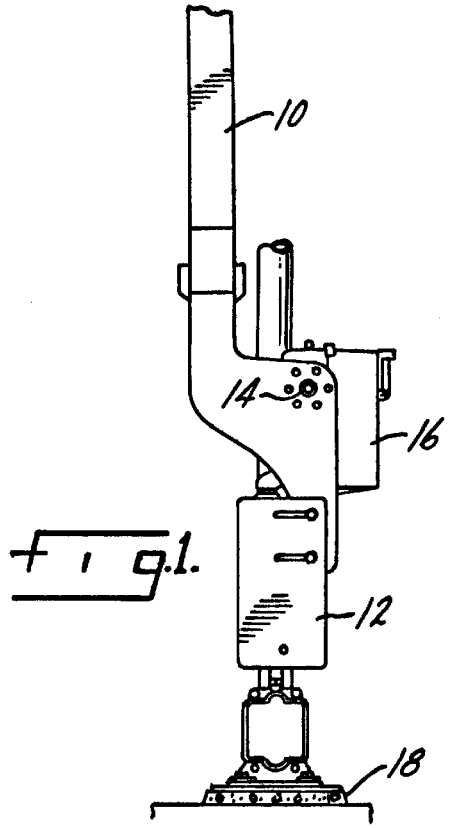
FIG. 1 is a diagrammatic illustration of a typical railroad highway crossing gate mechanism.

Existing railroad highway crossing gate mechanisms use 4 pole/4 field coil or 2 pole/2 field coil series wound or permanent magnet motors and operate in a generally uniform manner using direct current. The weight of the arm on the roadway side of the mechanism is offset by heavy counterweights on the opposite or field side. The balance is set at installation to favor the arm side as described by torque requirements in AAR Manual Part 3.2.15. This insures that the gate will move to a down position whenever there is a power failure. Arm descent is controlled by a motor power down circuit to a 45° position at which time the gate is moved by gravity to a full down position, with the down speed during arm descent being controlled by means of a motor generated snub circuit. Failure mode protection takes two forms. First, the gravity down snub circuit will control arm descent through the full 90° of arm travel in the event of a loss of power down or of a total loss of power. The second failure mode is a rapid up drive that can result from an arm knockdown and subsequent rapid descent of the heavy counterweights which is resisted at 45° by the motor power down circuit. The counterweights are held at or near 45° until control is restored, generally when the train clears the crossing. The torque of the up drive in this unbalanced condition is absorbed by a mechanical buffer spring.

Additional failure modes, while less common, can cause damage to the gate mechanism. Such are a loss of power causing the gate arm to descend, followed by an arm knockdown. There is now no power down to resist the rapid descent of the counterweights and the spring buffer cannot always absorb the full impact from 90° of movement. A further failure mode is arm knockdown with a damaged or misadjusted power down contact, resulting in the same condition as described above. Yet a further failure mode is arm knockdown during up drive. In this instance, the power down circuit is not engaged allowing full impact to the gate from 90° of movement. A further type of failure mode is an unbalanced condition of the arm and no counterweights, or counterweights and no arm, during installation or maintenance. While proper installation procedures should avoid any such problems, it is possible to accidentally allow an unbalanced condition, allowing the gate to move to a full up or down position in such a manner as to cause damage to the gate mechanism. Finally, poor brush contact in the motor can prevent generation of a snub current to control the gravity down arm descent. While not known to happen during normal operation in conjunction with power down, this can intermittently result if power down is not functioning correctly.

The present invention can provide protection against any failure mode and provide for complete and proper operation during normal up and down gate movement by the use of a motor which has two permanent magnet poles positioned between two series connected electromagnet poles, providing the high torque of a four pole series motor for normal gate operation, as well as significantly improved snubbing action during failure modes. The present invention further provides an auxiliary relay which can be used in maintenance situations to raise the counterweights when they have dropped down due to a broken gate arm.

FIG. 1 illustrates a typical railroad crossing gate mechanism. The gate arm is indicated at 10 and the counterweights are indicated at 12. The gate will move about a point of rotation 14 and it will be driven by a gate control mechanism and electrical motor with its associated circuit, all located within the housing 16. The gate structure will rest upon the conventional concrete pedestal 18.

Figure 2:
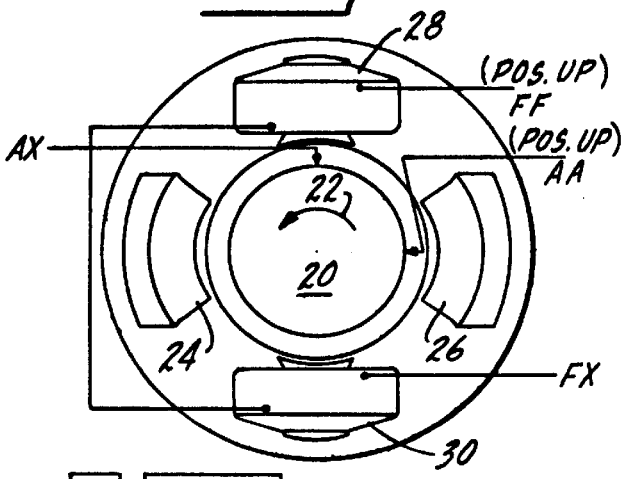
FIG. 2 is a diagrammatic illustration of the motor used in the control circuit herein.

FIG. 2 is a diagrammatic illustration of the motor. The motor armature is indicated at 20 and will rotate in the direction of arrow 22 during up movement. There are two permanent magnet poles indicated at 24 and 26 and they are diametrically positioned within the motor. There are two electromagnet motor poles, indicated at 28 and 30, which are series connected as will be illustrated in FIG. 3. The armature terminals are indicated at AX and AA, whereas, the terminals for the series wound coils for the electromagnet poles 28 and 30 are indicated at FF and at FX.

The electrical control system for moving the gate arm 10 through the up and 20 down positions includes a terminal board 32 in which terminals 4, 5, 6, 7 and 10 are pertinent to the operation of the control system. Terminal 8 is for the flashing light on the gate and terminal 9 is for the gate bell system. Battery power is provided to operate the gate and the battery negative terminal is indicated at 34 and battery positive terminals are indicated at 36 and 38. Terminal 38 represents an external control which is closed to apply battery voltage when the gate is raised and opened when the gate is lowered. Power down contacts are indicated at 40, a pickup circuit is indicated at 42 and an up position hold circuit is indicated at 44, both of which are conventional in crossing gate mechanisms.

Figure 3:
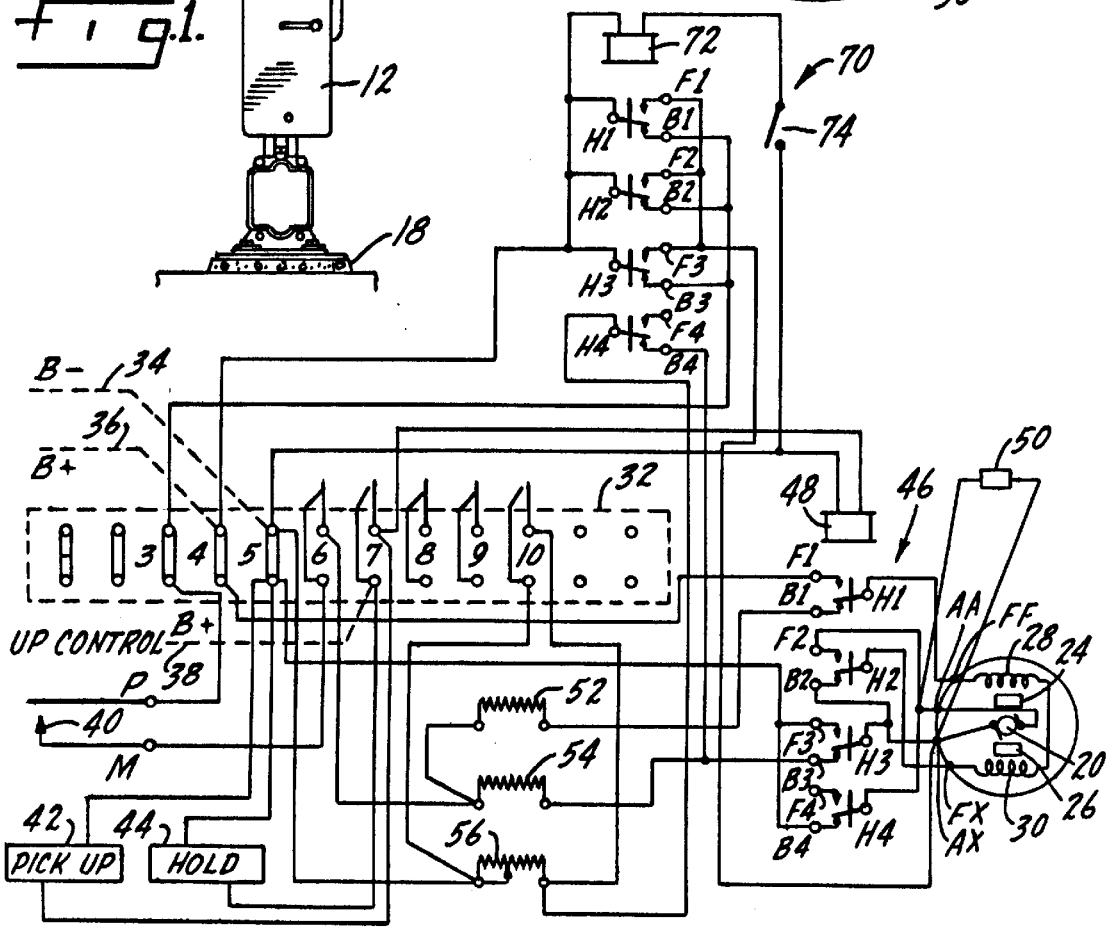
FIG. 3 is an electrical schematic illustrating the motor and the control circuit associated therewith.

The motor and snub relay is indicated generally at 46 and includes a relay coil 48 connected to battery negative at terminal 5 and connected to a battery positive terminal through the contacts of terminal 7 on board 32 which as shown in FIG. 3 are open. The contacts for the motor and snub relay, which is shown in the down position, are indicated as F1 through F4; B1 through B4; and H1 through H4. There is an overspeed module 50 which is connected directly across armature terminals AX and AA and will apply a resistance across the armature terminals when armature speed exceeds a predetermined level to thereby resist or snub armature movement above a predetermined speed of rotation.

Further snubbing controls are provided by a resistance 52, which will control motor speed, a second resistance 54, which will control motor torque, and a variable resistance 56 which will control both motor and gravity down speed to set descent time.

An auxiliary relay is indicated at 70 and includes a coil 72 connected through a normally open switch 74 to battery negative at the contacts of terminal 5. The opposite side of coil 72 is connected to battery positive at terminal 4. Switch 74 will normally be open and will only be operated by railway maintenance personnel in the event that maintenance is required or there has been damage to the gate arm and the counterweights have moved the gate to a full raised position. Under present practice, the counterweights are usually raised by a mechanical device which takes rather substantial effort on the part of maintenance personnel. The contacts associated with auxiliary relay 72 are designated as H1 through H4, F1 through F4, and B1 through B4.

The operation of the circuit of FIG. 3 will now be described in conjunction with typical up and down gate movements. Assuming the gate is in a down position, the contacts of terminal 7 on board 32 will be closed and the contacts of terminal 6 will be open. In this condition, the coil 48 of relay 46 will be connected to battery negative through terminal 5 and to battery positive through the closed contacts of terminal 7, to up control battery positive, as indicated at 38. Thus, relay 46 will be up and each of the F terminals of this relay will be connected to an H terminal, opposite to that shown in FIG. 3. With the relay in that position, battery positive at 36 will be applied to F1, through H1, to the FF terminal of coil 28, then through coil 30, to terminal FX, to H2, F2, to armature terminal AA, through the armature to armature terminal AX, to H3, F3 and then back to battery negative at terminal 5. The motor will then operate in the up direction to raise the gate from essentially a 0° position to approximately 89° or to an almost vertical position. At this point, the contacts of terminal 7 will open and the hold circuit 44 will maintain the gate in its full raised or vertical position. Hold circuit 44 is connected directly across terminals 5 and 7 so that battery power will be applied to the hold-clear device to maintain the gate in the up position.

When the gate is to be lowered, the power down contacts 40 will be closed and hold coil 44 opens, releasing the hold-clear device, the contacts of terminal 6 on board 32 will be closed, and the circuit through contacts 7 of terminal will open. Relay 46 will have dropped down to the position shown. Battery positive is applied from terminal 4, H3 and B3 of relay 70, through the closed contacts 40, to the bottom of terminal 6, to the common junction point of resistors 52 and 54. From the output side of resistor 54, power will be supplied from B3 to H3 and then to the armature 20. From the output side of the armature the circuit will be completed through H4, B4 and then back to battery negative at terminal 5. Thus, resistor 54 will regulate the power applied to the armature and will in effect control armature torque.

From the input of resistance 52, current is applied through the resistor to B 1, H1, through the series wound coils 28 and 30, to H2, B2, H3, B3, to the output side of resistor 54. From this point there is a connection to B4 of relay 70, to H4 of relay 70, through variable resistor 56, to battery negative at terminal 5 and/or from H3 through armature 20 to H4, B4 to negative at terminal 5. This described condition will prevail as long as switch 74 is open, until the gate reaches 45°, at which time the contacts of terminal 6 will open. Further down movement of the gate is by gravity as resisted by the snubbing current provided by the two permanent magnets through resistance 56 to 5° and full snub through contact 10 to 0° or horizontal. Resistance 56 limits down speed, as it is connected in circuit through the armature.

Auxiliary relay 70 normally is in the down position of FIG. 3, with its closed contacts being required to complete the circuit through snubbing resistor 56. In the event that the gate arm is broken and the counterweights move to a full down position and maintenance personnel require a power assist to raise the counterweights, switch 74 is closed, causing power to be applied to coil 72 from terminals 4 and 5, with the result that H4 of relay 70 is connected to F4 and no longer to B4, which opens the circuit to snubbing resistor 56. Full power is applied to the armature from battery plus terminal 4 through H1, H2 and H3 of relay 70; to F1, F2 and F3; to armature terminal AX, through armature 20, through H4, B4 of relay 46 and back to battery negative at terminal 5. Thus, full power is applied to the armature and all of the snubbing circuit and power down and rate limit resistors 52, 54 and 56 are bypassed.

The overspeed module 50 is connected directly across the armature and it will be activated whenever armature speed exceeds a predetermined limit. Placing such a resistance across or in parallel with the armature circuit reduces the current flowing through the armature, thus reducing armature speed, and thus gate speed.

During the period of gate movement from 45° to 0°, no power is applied to the field coils 28 and 30 of the motor. However, movement of the armature, due to gravity pulling the gate toward a horizontal position, will induce current in the armature due to the fields provided by the permanent magnets 24 and 26. The current thus-induced in the armature will resist downward movement, snubbing gate movement, permitting the gate to move at an acceptable speed to prevent damage to the gate and the gate movement mechanism. Thus, the permanent magnets will retard gate movement during the last 45° of a gate down operation.

In this connection, it should be clear that the permanent magnets will always induce some current within the armature and provide some control over armature speed during up and down gate movement and whether or not power is applied to cause gate movement.

In any failure mode, whether power is on or off, the permanent magnets 24 and 26 will always induce a retarding current within the armature, slowing armature rotation and thus gate movement, in either up or down directions and regardless of whether the gate has been knocked down or is fully operational, and regardless of whether there is power or no power. The permanent magnets provide in effect a fail-safe mechanism arresting gate movement at all times.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad crossing gate electrical control system for moving a crossing gate in up and down directions and providing snubbing protection to gate movement in failure modes, said control system including an electrical motor having two diametrically positioned permanent magnet poles and two series wound diametrically positioned electromagnet poles, an armature rotating inside of said poles, with armature movement controlling gate movement, a motor and snub relay having contacts thereof connected to said armature and series connected electromagnet poles, a terminal board having movable contacts thereon connected to the motor and snub relay and to a relay coil for moving the contacts of said motor and snub relay, a source of power connected to said terminal board, said terminal board moveable contacts controlling the application of power to said motor and snub relay coil and said motor and snub relay contacts for operating said motor to cause up and down gate movement, said permanent magnet poles providing magnetic fields which induce current in said moving armature which slows armature movement in both up and down directions of gate movement and in both power on and power off gate failure modes.

2. The control system of claim 1 further including an overspeed control connected across said armature.

3. The control system of claim 1 including resistance means connected between said terminal board contacts and said motor and snub relay contacts for controlling speed and torque of armature movement during at least a portion of gate down movement.

4. The control system of claim 3 wherein said resistance means includes a first resistor connected between said terminal board and said series connected electromagnet poles through said motor and snub relay contacts, and a second resistor connected between said terminal board and said armature through said motor and snub relay contacts.

5. The control system of claim 4 wherein said resistance means includes a third resistor, connected across said power source, through said terminal board, during at least a portion of gate down movement for slowing power down speed.

6. The control system of claim 5 wherein said third resistor is variable.

7. The control system of claim 4 further including an auxiliary relay connected in circuit with said resistance means and including a normally open switch, closure of said normally open switch connecting said auxiliary relay to said source of power to cause movement of auxiliary relay contacts to directly connect said armature to said source of power.

* * * * *